United States Patent [19]

Morrell

[11] 3,954,597

[45] May 4, 1976

[54] PROCESS FOR THE PRODUCTION OF DISTILLATE FUELS FROM OIL SHALES AND BY-PRODUCTS THEREFROM

[76] Inventor: Jacque C. Morrell, 4501 Connecticut Ave., NW. Apartment 516, Washington, D.C. 20008

[22] Filed: Mar. 27, 1974

[21] Appl. No.: 455,074

[52] U.S. Cl. ..... 208/11 R; 208/50; 208/75; 208/131

[51] Int. Cl.[2] ..... C10G 1/00

[58] Field of Search ..... 208/11, 131

[56] References Cited

UNITED STATES PATENTS

| | | | |
|---|---|---|---|
| 2,075,599 | 3/1937 | Alther | 208/11 |
| 2,474,345 | 6/1949 | Clark et al. | 208/11 |
| 3,093,571 | 6/1963 | Fish et al. | 208/11 |
| 3,135,618 | 6/1964 | Friese | 208/11 |
| 3,228,869 | 1/1966 | Irish | 208/11 |
| 3,384,569 | 5/1968 | Peet | 208/11 |
| 3,617,480 | 11/1971 | Keel | 208/131 |

*Primary Examiner*—Herbert Levine
*Attorney, Agent, or Firm*—Larson, Taylor and Hinds

[57] ABSTRACT

The invention relates to a unitary and continuous process to produce the desired products, divided for clarity of description, into two sections: (A) Retorting section and (B) cracking section-the first comprising a retorting section which in one principal aspect may be an essentially tubular vertical retort, one type of which is shown in FIG. 1; or in another aspect a horizontal rotating retort sloping downwardly, in which in any event the oil shale is heated indirectly by the hot gases of combustion, and are kept separate from the oil vapors and gases from the oil shale. The hot combustion products of the fuel in general move upwardly and out of direct contact with the shale and products therefrom. The fuel in general is producer gas made from the spent oil shale and/or coke from the cracking section, and alternatively hydrocarbon gases both from the retort and cracking section of the process all of which fuels in general furnish the heat to support the entire operation including refining, steam generation and power production generally, including electricity. The oil vapors (and gases) from the oil shale pass into a fractionator and/or partial condenser which is directly connected to the oil shale retort (and a part of section A) and wherein the light oil distillate and water (from the oil shale) are condensed, separated and collected as an overhead product; and the major portion of the shale oil, i.e., the hot liquid condensate from the bottom of a fractionator and/or partial condenser which is the charging stock for cracking section B, may be pumped by a high pressure hot oil pump together with the hot reflux condensate from the dephlegmator of cracking section B through the highly heated cracking tubes of section B, and into one of the reaction and coking chambers of section B wherein the coke from the reaction is deposited and accumulated until ready for switching to another chamber for periodic cleaning and removal of the coke. The vapors leaving the reaction chamber pass into the dephlegmator of cracking section B where the overhead cracked or pressure distillate containing the unrefined product of the process is condensed and collected and separated, and the hot heavier reflux condensate from the dephlegmator of the cracking section B is continuously recycled, together with the major portion of the hot shale oil from the fractionator of the oil shale retort section A, to produce on a continuous basis the desired products of the process. The retort section A including the fractionator, etc. both at relatively high temperatures of the process, is under substantially atmospheric pressure or may be made slightly less (by use of a suction fan) to avoid leakage; whereas the cracking section of the process is entirely under a relatively high superatmospheric pressure throughout the system; and all the heating elements and those directly attached thereto e.g. the heater or cracking tubes, reaction or cracking chambers, and dephlegmator are at relatively high temperatures. The by-products of the process other than those used as fuel e.g. those produced from spent oil shale and their uses are obviously secondary to those of the principal invention.

6 Claims, 9 Drawing Figures

FIG. 1a
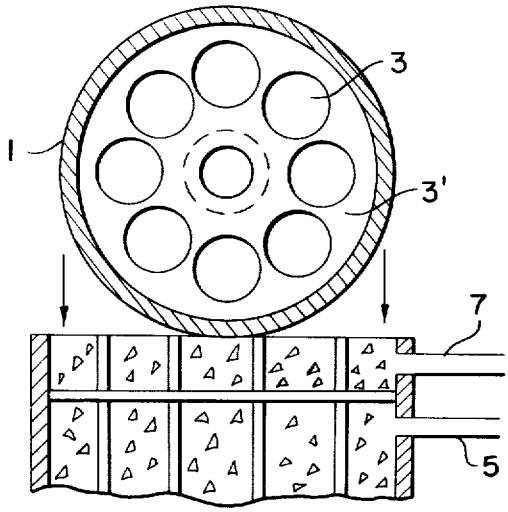
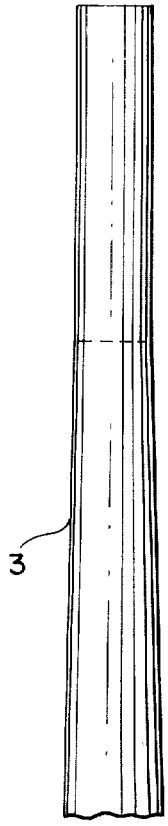
FIG. 1c
FIG. 1b
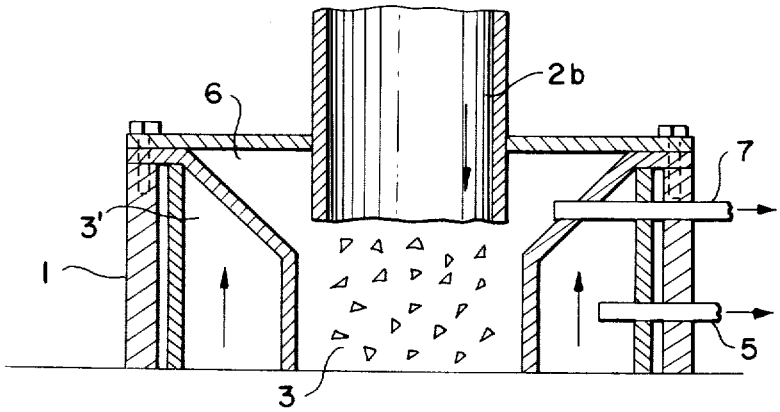

PROCESS FOR THE PRODUCTION OF DISTILLATE FUELS FROM OIL SHALES AND BY-PRODUCTS THEREFROM

BACKGROUND OF THE INVENTION

Including well over a half century of research and study by applicant in the fields of hydrocarbon chemistry and petroleum technology as well as studies of oil shales and shale oil as a likely successor of petroleum, as a raw material and source of the tremendous quantities of liquid distillate fuels required to meet the ever increasing demands for these products. Periodic studies were made of the trend in petroleum exploration, including deeper drilling and coastal shelf operation, (which extended the era and volume of production) on the one hand, and the economic requirements on the other, with of course the necessary innovation studies in the field from time to time to supplement the other factors. The crisis with respect to supplies of petroleum by the Mid East embargo, and its implications from the view point of our security and national policy, brought the subject to a head and crystallized the entire matter based on present as well as past thinking.

DESCRIPTION OF THE PRIOR ART

The prior art regarding oil shales relates mainly to the design and operation of oil shale retorts in Scotland and France and more recently in Australia as well as some lesser operations in other countries. The above foreign experience goes back for more than a century and while a number of improvements were made mainly in retort design, there is little basis of comparison between the prior art of the past with the requirements of the future oil shale industry in the United States. The reason for this is because of the very limited objectives of the past both with regard to type and variety of products and uses of the same as well as the required capacities demanded. To cite the Scotch experience, which is the best, particularly from the view point of plant design, their objectives were to make maximum yield of both ammonia as well as refined oil products (including lubricating oils, burning oils and waxes). These objectives were opposed to, and seriously limited, each other with respect to capacities of the retorts and the results with respect to the latter were far below requirements for projected U.S. practices. However, a fair comparison, because of the era and completely different objectives as indicated above, cannot be made. Development including some worthy research in the subject generally in the United States over the past fifty years have been limited with regard to production mainly to pilot plant retorts of a variety of designs, the merits of most of which remain to be proven. No unitary and continuous process comparable to that shown herein has been disclosed in the prior art.

SUMMARY OF THE INVENTION

The abstract of the disclosure above is a brief but fair summary of the invention which does not however describe the necessary details to show flexibility and continuity over long periods demanded from the process as is shown below. It does, however, outline the basic principles of the invention as disclosed in sections A and B of FIG. 1 which represent respectively the retorting and cracking sections of the process of the invention; and when read in the light of the more detailed FIGS. 1*a* and 1*b* which include additional features of important elements in connection with both sections A and B. It also refers to alternative retort types and designs shown later in FIGS. 2, 3, and 3A intended to remedy the capacity aspects of the oil shale retorts of the prior art when applied to projected United States requirements with respect to types and quantities of products for modern use. This includes equipment for mass production to which the invention is directed both as to principal products (referred to in the title) as well as the capacity and thruputs to meet the aforesaid demands: with maximum economy and simplicity of operation consistent with the tremendously important objectives of national security and independence.

PREFERRED EMBODIMENTS

FIG. 1, in essence is a flow sheet, which embodies the general principles of the process, but not all the necessary details. A selection of the elements of the over all process retort for section A could be made from two classes (*a*) the vertical tubular type illustrated in FIG. 1 or (*b*) the vertical type (in fire brick or ceramic setting) illustrated in FIG. 2. (2) The horizontal rotary type of retort illustrated in FIGS. 3 and 3A. FIG. 1A would fill the requirements of the fractionator and/or partial condenser since the necessity of its use is fully illustrated by its name and function i.e. to condense the major portion of heavier oil vapors from the retort within the column connected thereto to permit withdrawal of the same from the bottom; which may be pumped while still in a heated condition to the cracking section of the process: and to remove as overhead products the lower boiling oil fractions, and the water (which in any event must be kept out of the cracking section), as well as the incondensible gases, (including gaseous hydrocarbons and ammonia). These lower boiling fractions are condensed, and collected in the receiver and the gases pass to the gas separator. The heavier oil from the fractionator (and partial condenser) is withdrawn from the bottom of the latter and passed to the cracking section in which the preferred embodiment would be that shown in FIG. 1B plus the condenser, receiver, and gas separator illustrated e.g. in 1A with, suitable gas pressure controls (on the liquid receiver and gas separator) to maintain the required pressure on the system.

BRIEF DESCRIPTION OF THE DRAWINGS

The drawings are illustrated and discussed in connection with the numbers of the figures, which in turn are directed to various aspects of the process of my invention, and the equipment and means used in connection therewith. FIG. 1, section A depicts the fractionator and partial condenser which permits separation of an overhead product consisting of a light oil distillate comprising gasoline, and water which are condensed and collected in a receiver; as well as ammonia and hydrocarbon gases which are recovered. The major heavier oil product, collects in the bottom of the fractionator, and is pumped while hot to the cracking section of the process for conversion to gasoline and heavier oil distillates. Section A also includes a gas producer which is part of and supplies fuel to the retort system, and utilizes by-product solid fuel (including spent oil shale) to convert to producer gas.

Figure 1:
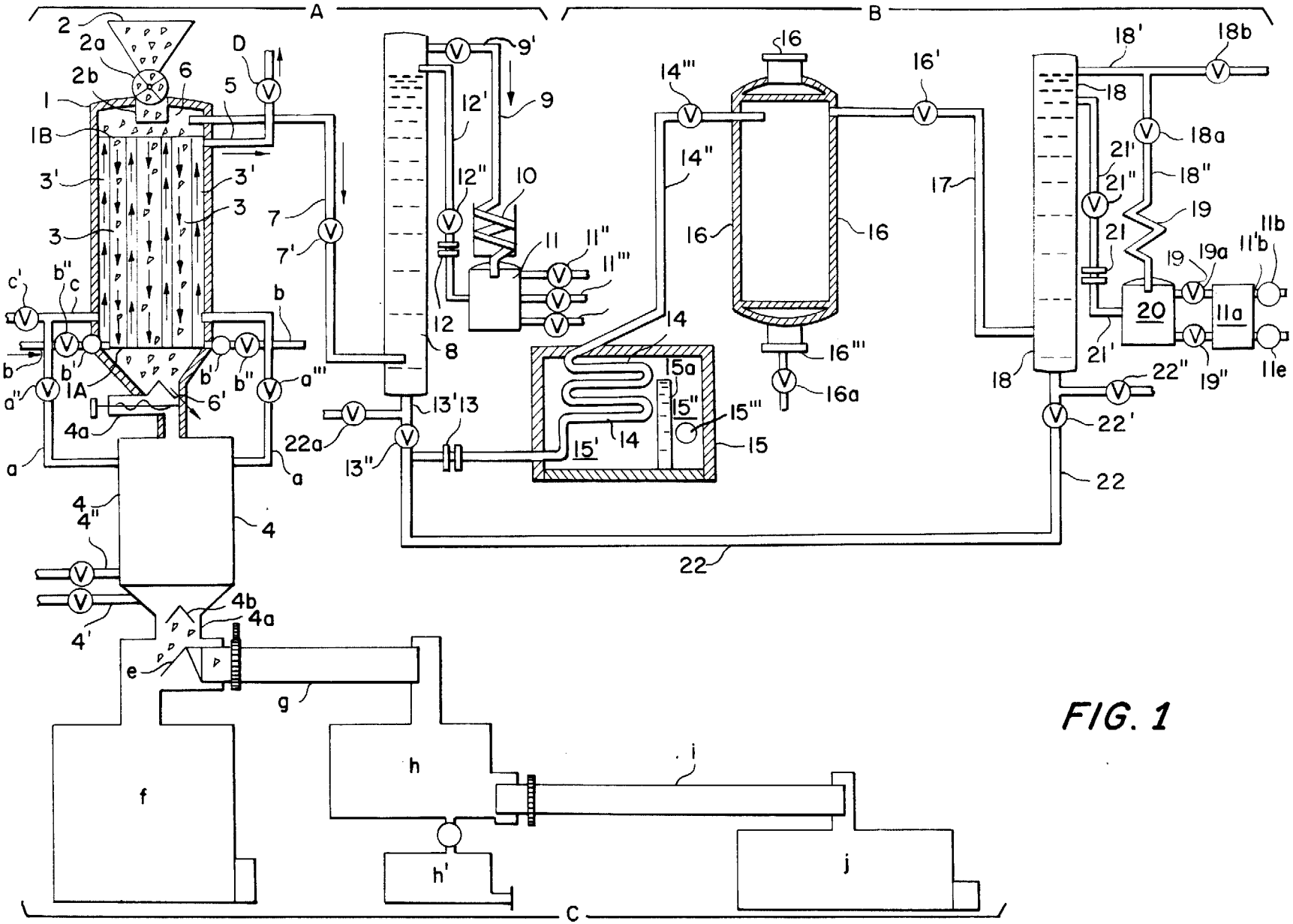
FIG. 1, essentially a flow sheet, is divided into sections A, B, C for convenience of description and discussion.

Section B is the cracking section of FIG. 1 which together with section A, consisting of the oil shale retort and the fractionator etc. constitute a unitary and continuous process for the production of cracked or pressure distillate which contains the gasoline and various other oil distillate products of the process already referred to; and from which the finished products may be obtained by a simple process of refining, disclosed herein.

Section C illustrates the method and equipment of producing refining earths etc. and cement from oil shale ash; which is produced from the spent oil shale containing carbonaceous materials which is converted to producer gas and used (at least in part) as fuel for the oil shale retort, and elsewhere.

Figure 1A:
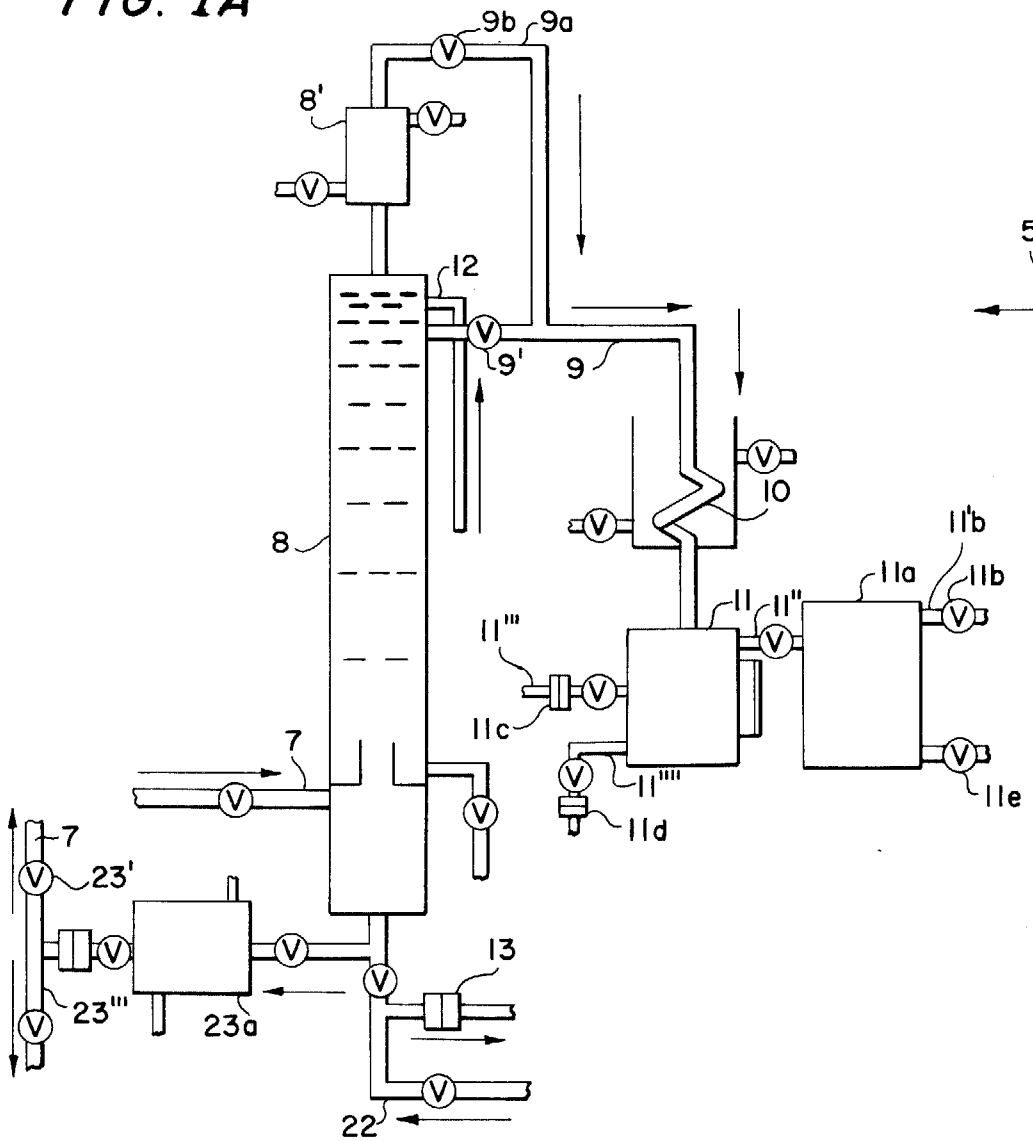
FIGS. 1*a* and 1*b* relate to various aspects of retort design as illustrated in FIG. 1, section A.

FIG. 1A illustrates in more detail the fractionator and partial condenser in FIG. 1, section A especially with respect to the use of a partial condenser in the top of the fractionator to more thoroughly perform the function of this element for collecting the heavier oil product for further treatment as well as a more detailed collecting system for overhead light oil distillate and water and gas and other important features thereof.

Figure 1B:
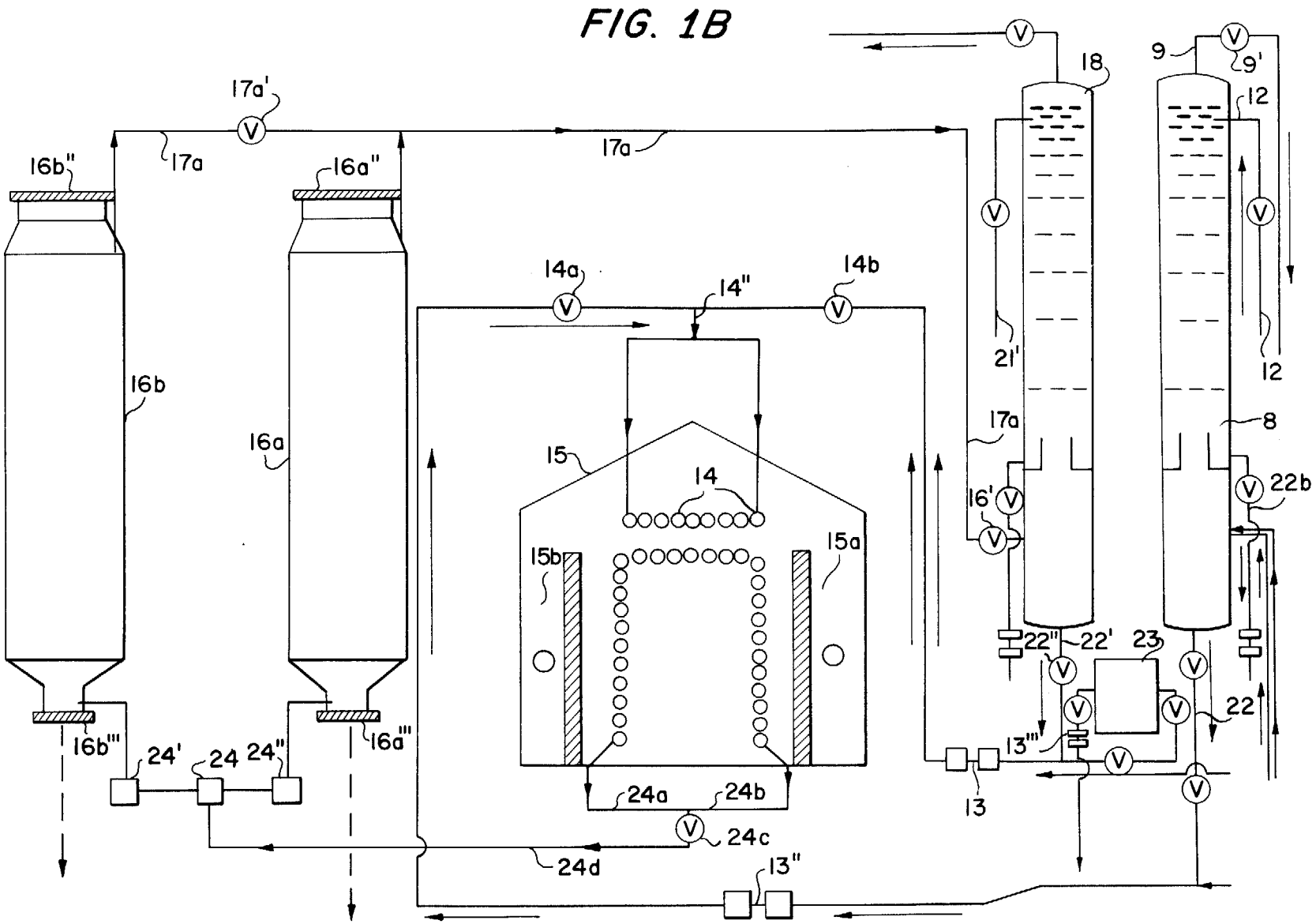

FIG. 1B likewise illustrates section B of FIG. 1 in greater detail to develop the important features thereof not shown in the latter particularly the arrangement for switching the reaction chambers in which the cracking reaction continues, and coke is accumulated until the chamber is switched for "clean out" during the continuous operation of the process. Also shown is the flow of oil to be cracked from the fractionator 8 shown in detail. FIG. 1B also illustrates the recycling of the hot oil in FIG. 1A (corresponding to FIG. 1, section A): from the dephlegmator corresponding to FIG. 1 (cracking section B); and the means and arrangements for pumping the hot oil with high pressure hot oil pumps.

It is noted that the various sections in FIG. 1 (more particularly section A and section B) (also as illustrated in the other figures) are inter-related as a unitary, continuous process to produce the desired results.

Figure 2:
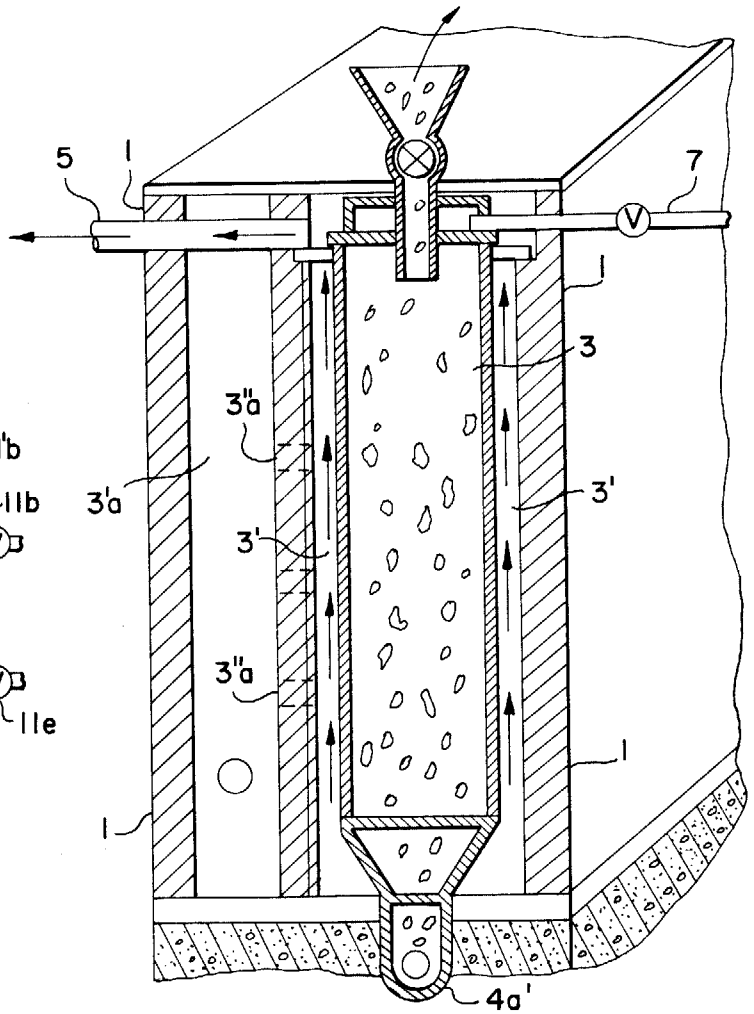
Figure 3:
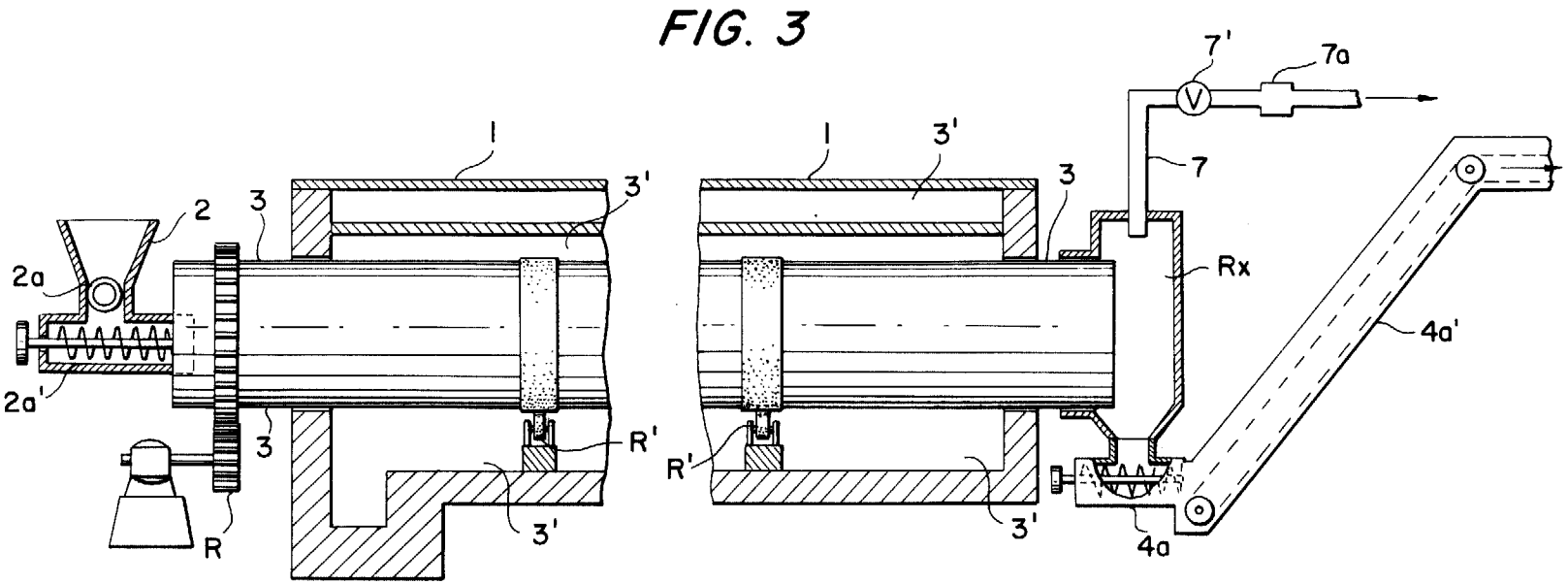
Figure 3A:
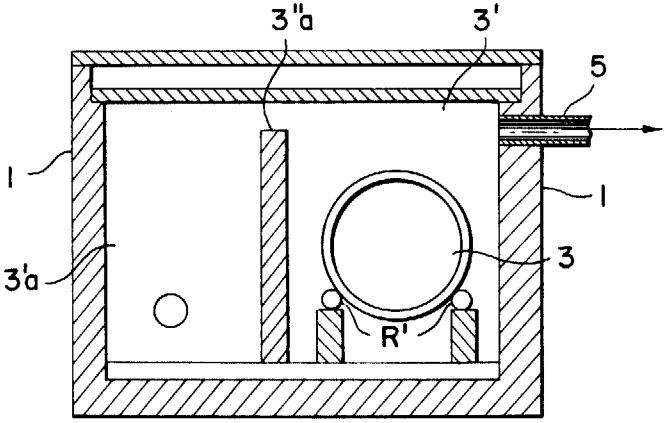

FIG. 2 relates to an alternate vertical tubular oil shale retort design with ceramic and/or fire brick setting preferably arranged as a battery of retorts to balance the cracking section B in FIG. 1, or as shown in FIG. 1B. FIG. 3 and 3A relate to the horizontal type of rotating retort for oil shale. Both of these types have special merit and are preferred types. Both are intended to be fully equipped with gas producers and other sources of by-product fuel and conveyors, etc. and with fractionator and partial condenser etc. as shown in FIG. 1A and with cracking section as shown in FIG. 1B.

The invention generally relates to the treatment of oil shales to provide oil products therefrom and more particularly relates to the process of treating the said oil shales in a relatively economical, practical and substantially continuous process to produce distillate oils including gasoline or motor fuels generally, burning or heating oils suitable as domestic fuels, diesel oils, jet fuels and similar distillate oils suitable for various uses including e.g. as raw materials for petrochemicals, etc; and as an alternate or substitute source for similar distillate products from petroleum. Moreover, it is intended to replace the latter and to meet the requirements thereof in all respects during critical periods such as the present Middle East embargo; aimed at a denial of necessary petroleum supplies and in fact it will serve to replace petroleum products in the future when petroleum production decreases which is already a rapidly developing situation substantially below normal and in fact fails to meet minimum requirements.

With regard to the general subject of oil shale, from the mineralogical view point, an oil shale is basically a rock of sedimentary origin (normally from clays), which has the composition structure and formation of a shale generally, (although considered by some as having a marl base): However, it does not yield oil on extraction with solvents. Oil shale is black or dark brown when broken and contains a substance generally referred to as "kerogen" which on destructive distillation by heat treatment, at or somewhat above a dull red heat, and higher produces an oil product generally similar to a hydrocarbon oil from petroleum, as well as hydrocarbon gas, and in addition it produces nitrogen bases, and ammonia; the latter generally in aqueous solution, since water is also a product of the heat treatment.

Oil shales are found in very large amounts in several parts of the United States as well as in other locations throughout the world. The oil shale deposits in the Green River Formation in Colorado, Wyoming and Utah, etc, are generally of good quality and occur in vast quantities, and as shown below oil shales occur in other parts of the United States.

As a general guide the amounts of oil produced varies with the type of oil shale, and conditions of treatment as well as other factors. As a further guide, a large percentage of the oil shale brought from the Green River Formation in Colorado, Wyoming and Utah and in some other parts of the United States may produce from 20 25 gallons (about one half barrel) per ton, and upward of 40 gallons per ton in some cases; although occasional beds in this formation may show about 60 to 90 gallons per ton on a selective basis. Comparable yields of oil from lesser known deposits may be found in Nevada and California, and to some degree in Montana. Oil shale deposits are also found in the Midwest and the eastern part of the United States e.g. Illinois, Kentucky, Ohio, New York, Pennsylvania, West Virginia and Tennessee; and oil shale in the same general formation (Devonian) yielding notable quantities of oil have been reported in Missouri, Kansas and Oklahoma. The latter are of lesser quality with respect to yield of oil than the Green River Formation. Tests on the Kentucky shales (Bureau of Mines) representative of the Devonian Formation show yields of about 16 gallons per ton. The latter group of oil shales are reported as being amenable to steam shovel mining operations to the extent of thousands of acres (which is an added attraction although offset to some extent by the ecology problem). Similarly situated deposits, of comparable yields, have been reported also in Illinois and Missouri and seem likewise feasible with respect to mining and oil production. It has also been noted in this connection that the deposits in Indiana and Ohio should not be ignored.

In general it is especially to be noted that because of the critical nature of the present worldwide petroleum situation, which (although it received its initial impetus as an international political problem); in any event will continue to pose a serious problem in the future to the United States as well as to the other important industrial countries throughout the world. It is important therefore to emphasize the practical as well as certain economic aspects of the present invention, which applicant considers the key to the solution of this problem.

In this connection, reliable reports have been made with respect to the feasibility of mining oil shale in the Green River Formation (Western Regions) using the regular underground method of coal mining. These reports emphasize that treatment of oil shales and similar operations to prepare the oil shale for retorting to produce crude oil therefrom are practical. Moreover, the question of availability of water and transportation in connection with the retorting and refining operations for the products therefrom, have also been considered: although the questions of treatment and allocation of water is in general a continuous national one and requires consideration and revision accordingly to meet the requirements of changing conditions and relative importance.

Additional reports made with regard to the quality of oil shale deposits in the Eastern Region (Devonian Formation, referred to above); particularly to the relative ease of mining the same by steam shovel methods over regular acreage in this region and the practicality of crushing the oil shale for preparation to retorting, as well as the availability of water and transportation in connection with refinery and other operations, are encouraging.

To follow up more specifically, official estimates of the availability of oil shale in the United States have been made which may serve as a basis for development in connection with the present invention, which it is noted provides the production of marketable products in greatest demand. In this connection a comparativly reliable estimate for the period in question within the scope of knowledge at that time of the Green River Formation and the Devonian (but not including all of the areas mentioned above) was made by the American Petroleum Institute in 1926, which was a period of intense interest in the subject. They reported an availability of approximately 400 billion tons of oil shale, from which they further estimated 100 billion barrels crude oil could be obtained. Recent estimates, reported in connection with the current crisis, state that the oil bearing shale in the Green River Formation which runs through Colorado, Wyoming and Utah contains an estimated 600 billion barrels of shale oil, enough to fill the country's needs at current consumption levels for almost 100 years and of course to this may be added estimates of the very considerable Eastern States (Devonian) deposits, and those more recently discovered. In any event the data and information shown warrant immediate action to establish a reliable first defense against future recurrence of any adverse situations in connection with supply of our critical energy needs. The development of our oil shale resources in connection with the present invention should provide this security.

As a conclusion in this regard it may be assumed from the above that there is, despite some attendant problems, a firm basis at present with regard to the question of availability of oil shales of good quality; and the relative practicality of mining operations as well as reported supplies of water, transportation, and the like which together with ample supplies of by-product fuel will take care of process and associated refinery operations, although the finishing refining operations involving chemical treatment as described herein could best be done at this stage in another area more suitable to disposal of the waste products. These developments together with the practicality of improvements in connection with the present invention of producing critically needed products such as gasoline, domestic burning oils, jet fuels, diesel fuels and distillate oil products generally demand immediate attention as in the present situation as well as in the forseeable future they will be in short supply; throughout the world because of the uncertainty of adequate petroleum supplies.

In connection with all of the above regarding availability of oil shales it must also be emphasized that my invention is useful and applicable, to many other countries aside from the United States which have extensive oil shale deposits, among which are Scotland, Canada, Australia, France and others.

This approach is any event will serve as a practical first line defense and permit the development of less certain answers to the solution of the immediate energy problem on a scale and in an orderly manner which avoids unnecessary loss of time and confusion, and at the same time recognizes and acknowledges the future value of these alternatives as well as the uncertain time factor connected therewith.

There is no question about the matter of reconversion to and use of coal in industry, heating of large buildings, transportation (especially steam engines for railroads), electric power production, large scale gasification of coal, etc, but one would have to give a hard look at economics of the conversion of coal in the production of liquid fuels from an all round competitive view point, especially in countries having ample supplies of oil shale. To those countries which do not have oil shale deposits the problem is of course different. Other sources of energy would depend upon a more rapid industrial development of atomic energy and fusion processes to meet present needs. These and others such as solar energy, geothermal energy, wind and tide power do have value in different degrees, and all should be considered and the work to be done upon them emphasized each in its own order. However, with respect to meeting the time and volume requirements of the immediate problem the answer, as stated, appears obvious, namely the development of a large scale oil shale industry according to the processes described herein.

It is especially emphasized at this point that the present invention for the treatment of oil shales to produce gasoline and other fuel distillates in addition to by-products of the process and that the process of the invention is relatively simple with respect to economy and operability as well as being both novel and useful. Also the means employed have novel application. Moreover the process is a unitary and continuous one.

Referring to FIG. 1, which shows diagrammatically the main principles of the process; presented for convenience of reference in the form of a flow chart divided into several sections, e.g. Section A, retort as well as the fractionator for separating the heavier oil shale fractions for further treatment in the cracking section, also with accompanying gas producer and heating system for the retort; Section B the cracking system to convert the major portions of the heavier liquid products from the retorting system A all of which are a part of a unitary and continuous process to be fully described below; and Section C the section for dealing with the spent shale ash (after removing the carbonaceous materials therefrom) and utilizing the heat from the same from the gas producer) to convert a portion thereof into useful products described below and the remainder of the spent shale ash can be used to remedy damage (which may result in mining the oil shale) to the environment or ecology referred to below.

With particular reference to Section A relating to the retorting of the oil shale comprising the oil shale retort 1 so arranged in the interior that the shale which is fed in through hopper 2 the latter being equipped with feed mechanism 2*a* which permits the oil shale to pass into the retort while preventing the gases and vapor evolving in the retort from escaping. The oil shale which is previously crushed to suitable sizes of pieces, preferable from about ½ inch to 1 inch more or less, and utilizing the fines, e.g. down to ¼ inch for retorting. The retort may be arranged in a battery of several units as found convenient to meet production requirements and to maintain a balance between capacities of the retorts in section A, and the cracking section B which is an integral part of the process and which will serve generally a number of retorts, e.g. in a battery. The oil shale passes from the top downward indicated by the heating tubes 3 as shown, and is heated and decomposed by the hot gases passing around the outside of the heating tubes resulting from the combustion of fuel which may be, either or both, producer gas and cracked gases as a product or by-product of the process.

The fuel passes from the gas producer 4 (to be discussed below) which in general employs by-product carbonaceous materials through lines *a* and *a'* controlled by valves a'' and a''' and passes into the retort to be burned in the annular spaces around the heating tubes in closely controlled coordination with air, employing of course the necessary safety and heat efficiency means. The air is supplied through lines *b* and *b'* controlled by valve *b''* and *b'''*. Lines *c* and valve *c'* provide fuel gas when needed from other sources. The burning gases and hot gaseous products of combustion pass upward illustrated by arrows around the heating tubes containing the descending oil shale, (likewise illustrated), in countercurrent flow and out of contact with each other, to avoid mixing combustion gases with the oil vapors and product gases from the process, but in heat transfer relationship with each other. The hydrocarbon oil vapors and gases which are desired product of the reaction produced by the decomposition of the active oil forming substance in the oil shale referred to as "Kerogen" etc. pass upwardly through the descending oil shale. The heating tubes may be considered as large diameter pipes or small individual retorts, (Note FIGS. 1*a*, 1*b*, 1*c* and FIG. 1) preferably made of heat and corrosion resistant alloy steel or cast iron fixed in the plates top (1B) and bottom (1A) which confine the hot combustion gases in the retort during their passage therethrough (and prevent their mixing with the oil vapors) in the spaces 3' around the heating tubes 3 and to line 5 controlled by valve D where it may be heat exchanged to generate or to super-heat steam (or the heat otherwise used) before passing into the chimney or stack.

The hydrocarbon vapors and gases from the oil shale rising in retort heating tubes pass into the space or compartment 6 into which the oil shale is introduced into the retort and then leaves compartment 6 and passes through line 7 controlled by valve 7' into fractionator and partial condenser 8 where it is separated into light overhead fractions containing hydrocarbon oil vapors and gases as well as an aqueous fraction and the higher boiling condensed topped shale oil which is withdrawn from the bottom of the fractionator for further processing. It is noted here that there is generally a considerable water content in the oil shale, which may be utilized where necessary, after recovery of ammonia contained therein. Also nitrogen bases are present in the overhead product. The vapors of the overhead fraction (consisting principally of a light oil, and aqueous fractions) may be passed through line 9 controlled by valve 9' and through water cooled condenser 10; and the resulting liquid and uncondensible gases are then passed into receiver 11 from which the gases may be withdrawn through line and control valve 11'' and the liquid oil through line and control valve 11'''. The water may be removed through line and valve 11''''. Line 11'' on the receiver may be equipped with a fan or similar device, which may be used as found necessary to create a slightly reduced pressure to induce the flow of the gases. (The latter may prove expedient to assist in avoiding leaks within the retort). The gases withdrawn from the receiver may be washed free of ammonia (with water) which may be recovered as such or as ammonium sulphate useful as fertilizer, etc. The liquids in the receiver comprise a heavier water layer which is withdrawn through line and valve 11'''. (It is noted that it is desirable to remove gases to a separator or receiver 11*a* which is shown also in connection with FIG. 1A, with suitable valve control, and from there to storage). The light oil layer may be withdrawn through line and valve 11'''. Dissolved basic components in the water may be recovered. The light overhead distillate may be recovered and combined with the major distillate product of the process from section B before refining the latter, or refined separately as described below. A portion of the light distillate is recycled into the top of the fractionator to assist in controlling the degree of condensation in the fractionator, and the physical properties of the overhead distillate as well as that of the heavier oil condensate or reflux in the fractionator. The distillate from the receiver may be pumped 12 through line and valve (12' and 12'') into the top of the fractionator 8 to accomplish this objective. It is noted in connection with FIG. 1 that the pressure in the retort in section A is substantially atmospheric whereas that in the following section B, described below, is high pressure throughout.

With regard to retort design relating to capacity (or throughput) of oil shale, heat transfer and operating questions generally such as charging the heating tubes etc. FIG. 1*a* and FIG. 1*b* in section A illustrate a basic design utilizing a multiplicity of heating tubes and distribution of the same, and another shows a single large heating tube. The full circle in 1*a* illustrates (when properly centered) a satisfactory design, the dotted circles illustrates an area for compromise of location. In both cases a separate circular element around the edge of the plate (with an approximate triangular cross section or other device) may be fitted to promote downward movement of the oil shale into the heating tubes. FIG. 1*b* illustrates a large heating tube or in effect a large single tube retort with special top designed to promote flow of the oil shale (in effect a funnel shaped top) and arrangement for fitting the various elements together. This of course could be varied in relative sizes or diameters. It may be noted that in the case of this type of retort design the setting or outer walls could very well be made of fire brick or suitable ceramic material for heating and flow of combustion gases and the metal flues fitted therein for the passage of the oil shale, and upward passage of oil vapors and gases therein maintaining the general principle of keeping the latter separate from the combustion gases. In the event of special cases where there is need for a positive mechanism to move the oil shale charge into the flue a revolving metal rake suspended on a vertical shaft rotating on a bearing and supported by the underside of the feed hopper and geared to a motor outside the retort or other suitable arrangement to serve the purpose.

In addition to the above comments the following are to be noted in connection with retort design and operation control of the same. In order to avoid the tendency for the heated oil shale to stick to the inner sides of the retort as it passes downward (especially in the vertical tubular type of various sizes and arrangement as shown herein) the latter may be flared, by gradually increasing the diameter of the tube from about one-fourth to one-third down from the top to the bottom to slope the inside of the retort somewhat outwardly (as shown in FIG. 1*c*).

The elements of FIGS. 1*a*, 1*b* and 1*c* are numbered the same as in FIG. 1 to identify corresponding elements performing the same or similar functions.

Further, in order to control the thruput of the oil shale, the latter may rest upon a pair of toothed rolls, which are arranged mechanically to be rotated towards each other at a regulated rate to control the residence time and discharge rate of the oil shale passing through the retort. As an example in the case of the retort described in connection with FIG. 1; the toothed rolls are fitted into the bottom of the same, above the cone shaped dischage valve 6' the latter being fitted with suitable mechanism to be raised and lowered and adjusted at will to meet operating requirements.

The toothed rolls or other means performing the same function are likewise equipped with suitable mechnism controlled from outside the retort to regulate the rate of discharge of the spent shale, and simultaneously the time of heating the oil shale under the selected temperature conditions.

Reverting now to the heated oil from the retort section A of the process to the cracking section B thereof, both in FIG. 1: the heavier oil condensate from the bottom of the fractionator 8 is withdrawn thru line 13' and valve 13'' from the latter by high pressure hot oil pump 13 and pumped at relatively high pressure into heating coil 14 (generally referred to as heating tubes) with return bends or elements which serve this purpose, (generally suitable threaded elements fitted with threaded plugs) which permit cleaning the heating tubes periodically. The oil entering the heating or cracking tubes is raised to a cracking temperature, for example of about 850 to 950° F. under a pressure of about 100 to 250 pounds. (The lower range conditions may vary considerably as shown in the examples given below where both the temperature and pressure may be considerably less in the low range e.g. between 750° to 850° F., and the lower range of pressure between 100 and 150 pounds). It is noted that the range of both temperatures and pressures are generally lower for shale oils, in comparable fractions than those from petroleum. The heating tubes which are generally made of alloy steel to prolong their life are located in a furnace setting 15 divided into two sections by partition 15*a* which permits hot gases to pass into the other section referred to as the heating and combustion section respectively 15' and 15''. The firing port is designated as 15'''. Heating may be done with gas using producer gas or cracked gas, or a mixture, and other available fuels as desired; generally obtained as a product (or by-product) of the process. The highly heated oil at cracking temperatures is passed through line 14'' controlled by valve 14''' and is discharged into cracking and coking, or reaction chamber 16 (likewise under pressure) which may be controlled by valve 16'. These chambers additionally facilitate storage of coke made in the process, and may be of the order of 10 feet diameter, and up to 40 or more in height. In order to maximize the yield of light oils the process is operated on a what is known as the non-residuum process by which is meant that in general no liquid residuum is withdrawn as a product from the chamber. Also that the heavy oil entering the chamber is cracked practically completely to coke as a residual product: and distillate fuels as overhead products which may be refined into gasoline, domestic fuel or burning oil, diesel fuel, jet fuels and the like.

It is important to emphasize in order to maintain continuity of operation of the process from an economic view point and in general, that in the present process with the oil shale as the primary charging stock in the retort; the operation of the cracking section B with a relatively heavy oil on a non-residuum basis producing coke as a residue (and specifically with the hot shale oil as the charge) would demand more than one reaction or cracking (and coking) chamber e.g. at least two chambers and preferably three (with one as standby) for each battery of retorts. Although not shown in FIG. 1, it is to be understood that to maintain a balance it is necessary to have standby chambers with valves and lines, etc. caapable of being switched from one to the other, as in FIG. 1B which in any event is a practical and economic operating expedient. Moreover, in order to maintain continuity of operation of the process as a practical matter two or more chambers should be used in each cracking section of the process: which it is emphasized is a unitary and continuous one from the charging of the oil shale into the retort to the recovery of the final distillate products in the receiver of the cracking section. The use of the terms "retort section" and "cracking section" are for clarification in presentation only, since both parts of the system are inherently inseparable from each other and the remaining elements of the process. The primary oil distillate product collected in the receiver of section B needs only refining and distillation to produce the variety of marketable and useful products of type referred to herein.

With respect to continuity of operation in cracking section B, after filling a chamber with coke (and while the coke is being withdrawn from the full chamber, using any one of several proven methods described below), the alternate chamber is to be properly connected by the switching arrangement shown in FIG. 1B to continue the operation. Cleaning of the alloy steel heating tubes (with special return bends or elements equipped with threaded plugs) is on a relatively much longer schedule and offers no special problem with respect to continuity. The cracking members may be equipped with manholes and covers 16'' and bottom 16'''. Cleaning out the accumulated coke in one method is accomplished by suspending steel cables inside the chamber and removing the coke by pulling out the cable when full. Another method of removing the coke is to drill a large hole through the entire mass of coke, and removing the coke in sections by lowering a hydraulic device which cuts the coke as it advances and permits removal of the pieces. Both of these methods (as well as other methods) may be employed; at least three of which have been fully tested. Coke from the cracking of shale oil is a high BTU fuel as such with low ash and useful for producer gas and other purposes e.g. as low ash carbon electrodes. As already mentioned in this connection, the process itself is self sufficient as well as for other needs with respect to fuel requirements i.e. producer gas from spend shale, retort gases, and gases and coke from cracking section B from the by-product fuel sources alone.

To continue the operation of the cracking section B of the process; vapors and/or gases from the reaction chamber pass through line 17 into dephlegmator 18 where it is separated into and overhead fraction consisting of mainly oil distillates referred to as pressure distillate, in the boiling range of a variety of distillate products from which when refined may be produced gasoline, domestic heating oils, diesel fuel, jet fuel and the like. The vapors pass through lines 18' and 18'' controlled by valve 18*a* and through water cooled condenser 19 and into the receiver 20. Valves 18*a* and more particularly 19' may release the gas for use or storage; and more importantly it controls the pressure on the entire cracking section B of the process; valve 19'' controls the draw off of the pressure distillate which contains the raw gasoline and distillate fuels (unrefined) already referred to as the principal products of the process after refining. The gas passes from receiver 20 thru line 19*a* controlled by valve 19' to separator 11*a*, from, which it passes to storage thru line 11'*b* controlled by valve 11 *b* which also may control the pressure upon the entire cracking section B of FIG. 1. 11*e* near the bottom of the separator is the means for draining the same. some distillate is recirculated through pump 21 and line 21 and valve 21'' into the top of the dephlegmator which cools and condenses the heavier portion of the vapors arising therein; and the hot condensate therefrom (occasionally referred to as reflux condensate) is circulated through line 22 controlled by valve 22' to join the stream of the heavier and major portion of hot shale oil leaving the bottom of fractionator 8. The combined streams are then pumped by the high pressure hot oil pump 13 through the heating coil and into reaction and cracking chamber 16 in the cracking section of the process, to complete the cycle of the process. Lines and valves 22*a* and 22'' if desired for special operation are for draw off use, sampling, etc., or pumping to storage after heat exchange.

Reverting to the producer gas operation to furnish fuel for self-sufficiency and economy of the process in furnishing fuel for the overall operation. The basis for this is the first instance the conversion of the fixed carbon in the spent oil shale (amounting to about one-third of the latter), and its utilization for fuel. It also serves to clean up the spent shale for the other uses referred to below. In the process the spent shale passes from the retort and is carried by the conveyor (illustrated by the screw or ribbon type), 4*a* while still hot into the gas producer 4. The latter may be defined as a vessel containing a thick layer of solid fuel reduced to suitable size, high in carbon, through which air or a mixture of air and steam is passed, with the object of converting the carbon of the spent oil shale to a gaseous fuel, illustrated by lines 4' and 4''. In this connection when air is used alone the fuel is largely carbon monoxide; when steam is added, hydrogen as well as additional carbon monoxide is formed; so that the fuel mixture may be carbon monoxide and hyrogen; with some nitrogen and carbon dioxide resulting from the reaction. Established principles in connection with both producer gas and water gas; and combinations thereof are observed in this connection in addition to the novel uses in the present connection. It must also be borne in mind that the gas resulting from the retorting of the oil shale itself, as well as the gases from the cracking section of the process offer additional quantities of high BTU fuels in this connection as well as in other parts of the overall process. Also the coke from the cracking process may be used as such, or as an additional source of producer gas alone, as well as in admixture with the gas referred to above. Moreover, as already pointed out, all the fuels may be used for the purposes needed both in the process (overall) as well as for refining and steam generation and power generally to conserve the liquid fuel products of the process and to maximize the yields thereof. From about one quarter to one third of the weight of the oil shale becomes available as by product fuels of the process operations at the site of the oil shale deposits and mines; as well as for power and energy generally for the activities connected therewith. These sources referred to on pages 21 and 22 (and elsewhere) are generally the carbon on the spent shale (about one third of the latter by weight, and the gas produced in the retorting of the oil shale, as well as in addition the coke and gas produced in the conversion of the shale oil into gasoline and heavier distillate products produced in the cracking section of the unitary and continuous process. A heavy residue liquid fuel oil may also be produced as described herein in the latter connection, which in some circumstances may be found to be useful. In addition to those various sources of energy the heat exchange operations referred to herein making use of otherwise waste heat, should prove useful as found necessary. The foregoing is a most important factor and requirement in the development of an oil shale industry, and in connection with applicant's process because of the necessity in general of a broad scale of operations and associated activities including mining operations at the remote locations of the oil shale deposits; and thus incidently lends a high degree of utility to the novelty of the invention.

Section C of FIG. 1 relates to the utilization of the clean shale ash recovered from the gas producer primarily to conserve the environment and ecology which is important, as well as to make valuable by-products therefrom. With regard to the ecology aspect, there is a substantial increase of volume (up to about 20 to 25%) of the completely processed ash over the original oil shale volume. It is delivered from the gas producer in lump form and ready to use for refilling the excavation from which the oil shale is mined; or from some relatively simple further processing of the excess volume (20 to 25%) to make refining agents e.g. (a) adsorbents (comparable to the same uses as fullers earth) and (b) catalysts for further treatment, as found expedient, of the pressure distillate received from the process to improve the gasoline therefrom as well as the other distillates. However, the distillates may be otherwise chemically treated also, e.g. with sulphuric acid etc, preferably in a more suitable and distance use to dispose of or recover sludges etc. to produce commercial products, (c) another product which may be made from the ash is cement. The basis for all these possibilities is the similarity of composition and structure to the above products, e.g. in the case of the absorbents and catalysts; and of cement, some limestone may have to be added. The degree of preparation of the raw ash as it leaves the gas producer is very little as in effect it is already advanced in preparation at that stage. A brief description of the flow of the shale ash from the gas producer is shown below. With regard to this, the ash from the producer passes through the bottom of the producer 4*a* controlled by element 4*b* and passes over divider *e*, the major portion passing into spent shale storage for return to the mining excavation from which the oil shale is removed, in the interest of restored ecology. The minor portion about 25% passes through ball mill and the ground (ash) is delivered to storage *h* and *h'* for adsorbents and catalysts to be used in refining; and the portion allocated to cement, (which aside from the ordinary uses may be useful in part to consolidate the fill for the excavations as well as for construction generally) is diverted to the rotary cement kiln *i* using normal conditions and the product is diverted to cement storage *j*. The raw materials for cement may require some addition of limestone which may be determined by analysis.

FIG. 1A illustrates a more detailed view of the fractionator 8 shown in FIG. 1, retort section A. It also illustrates the use of an added partial condenser or heat exchanger generally 8' the vapors passing thru line 9*a* and valve 9*b* (which if desired may be by-passed through valve 9' and line 9*a*) to more clearly control both the overhead distillate (consisting of aqueous and light oil distillate fractions) which is collected in the receiver 11 in addition to the gas which passes over from the receiver to equipped with distillate drawoff, line 11''', and pump 11*c*; and water drain line 11'''' and pump 11*d* to the gas separator 11*a*; from which the gas passes to storage through line 11'*b* and valve 11*b*. The gas separator is also equipped with means for drainage 11*e*. The fractionator is also equipped with means 12' as shown in FIG. 1 for recycling the light oil distillate from the receiver to the fractionator (to assist the separation of the light oil vapors from the retort through line 7. The heavier reflux fractions, in effect the topped oil shale crude, as shown in section B of FIG. 1 (and in FIG. 1B, is pumped by high pressure hot oil pump 13 to the heating tubes and reaction chamber to be converted to distillate fractions comprising gasoline, domestic burner oil, diesel fuels and jet fuels as described in connection with FIG. 1 and 1B. FIG. 1A also shows the hot reflux recycle (from the dephlegmator 18 shown in FIGS. 1 and 1B) through line 22 which also passes through the high pressure hot oil pump 13, together with the hot oil leaving the fractionator. Alternatively, the hot oil may be drawn through heat exchanger 23*a*, from the bottom of the fractionator to be cooled and pumped to storage through pump 23*b* and line 23'' or if desired through line 23''' to the cracking section of the process.

FIG. 1B represents a more detailed version of cracking section B of FIG. 1, and also includes the fractionator 8 of retort section A of FIG. 1. FIG. 1B illustrates the oil vapors from the oil shale retort 1 in section A of FIG. 1, entering the fractionator at 7 (with drawoff means 22*b*) and also light oil vapors leaving the fractionator 8 together with the gases as described in connection with FIG. 1 section A and in FIG. 1A: recycle 12 of the light oil distillate from the retort section is for the purpose of controlling functioning of fractionator 8. The heavier fraction comprising essentially the topped shale oil leaving the bottom of the fractionator 8 (section A or FIG. 1A) passes downwardly through 8 and through line and valve 22 and may be pumped by high pressure hot oil pump 13'' through the transfer line 14'' controlled by valve 14*a* and thereafter to the heating and/or cracking tubes 14 or alternatively passes through the heat exchanger 23 where it is cooled and may be pumped by pump 13''' to storage, in special situations, as required. Additionally and alternatively the hot oil from the fractionator 8 (FIG. 1 and FIG. 1B, section A) may be pumped through high pressure hot oil pump 13 together with the reflux from the dephlegmator 18 of the cracking section-FIG. 1B (hot oil pump 13 being of the same type as 13', i.e. of the high pressure hot oil type), and the combined streams (or selectively) of hot oil pass through transfer line 14'' into the heating and cracking tubes located in the furnace or heater 15. Pressure on the heating and cracking tubes are controlled by valves 14*a* and or 14*b*. The firing of the furnace is preferably done in a separate zone, or zones, 15*a* and 15*b* similar to 15'' in FIG. 1 section B. The combustion gases, (after utilizing the heat thereof to produce steam for power, or refining, or by heat exchange) in general pass through the stack. The fuel used to heat the oil passing through the cracking tubes may be gases from the retort, producer gas made from the coke produced in the cracking section of the process; and/or the cracked gases from the process. The highly heated oil leaving the cracking tubes 14 passes through lines 24*a* and 24*b* controlled by valve 24*c* and line 24*d* and through appropriate switch valve selected from 24, 24' or 24''depending on which of the two reaction chambers 16*a* or 16*b* is employed and ready for use while the coke in the other is being removed and the chamber cleaned for reuse. A third chamber not shown may also be used as standby. The cracked oil vapors and gases leaving the reaction chambers pass into the dephlegmator 18 through line 17*a* controlled by appropriate valves 17*a'* and 16'. The overhead vapors leaving the dephlegmator 18 through line 18' controlled by valve 18*a* and pass together with the gases through a condenser and into a receiver and gas separator with appropriate valve for pressure control, all disclosed in connection with section B of FIG. 1, and the cracked or pressure distillate is withdrawn from the receiver for refining as described later. A valve on the receiver corresponding to valve 19' is used for gas relief and pressure control in the cracking section B of FIG. 1, and the gas may pass into gas separator (as shown in FIG. 1A) also with pressure control valve; and to storage. This same section may of course be used in connection with FIG. 1 section B also shown in the latter. Distillate recycle 21' as shown in section B of FIG. 1 may be used to control separation in dephlegmator 18 of FIG. 1B. It is noted here in general that the pressure on the cracking system or section of the process is substantially the same throughout all parts of the latter; and is controlled by suitable valves in the distillate receiver as well as gas release, and pressure control by valve on separator. It is also specifically noted that whereas the oil shale retort as well as the fractionator of the retort section A of FIG. 1 and FIG. 1A are substantially at atmospheric pressure; cracking section B of FIG. 1 and FIG. 1B are at high pressure generally between about 125 pounds to 250 pounds: depending upon a number of factors the pressures for shale oils may vary beteween 125 and 200 pounds more or less for different operations. It may also be noted that the operation of the cracking section of the process in FIG. 1B is essentially the same as that described in FIG. 1 section B taking into account of course the difference in specific features and details shown of each.

With regard to the removal of coke, several methods may be employed which may be briefly described. (1) The oldest and most general method is to suspend a flat cord of steel cable in the reaction of coking chamber, and when the latter is full of coke, to remove the same by pulling the cable and the coke from the bottom of the chamber. (2) The hydraulic method employs high pressure water jets to remove the coke after boring a hole through the latter. Another method employs a drill stem to drill the coke mass in various directions disrupting the latter and permitting removal.

Referring to FIGS. 2, and 3 and 3A, the notations on the drawings and explanations thereon explain the various elements and the overall principles involved. In general it is noted that FIG. 2 is a vertical retort, or more correctly is intended to represent a battery of a number of retorts of the type depicted, all in the same setting and receiving their heat from the same source. It is further noted that the furnace or heating setting in FIGS. 2 and 3 is fire brick, or similar ceramic material, but the retort 3 itself is iron or steel similar in use to the vertical "cylindrical" type employed in FIG. 1, e.g. as depicted in section A, preferably tapered as in FIG. 1C. The general principle of heating in FIGS. 2, 3' and 3A (a crossection of FIG. 3) is the same as that in FIG. 1; with respect to keeping combustion gases 3, separate, in all cases, from the oil vapors and hydrocarbon gases 3 (as illustrated in FIG. 1) resulting from the decomposition of the descending oil shale in the vertical retort of FIG. 2: and the same principle applies to the rotary retort (horizontal) of FIG. 3, and FIG. 3A which is a cross section view of FIG. 3. FIG. 2 and FIG. 3 are similar to each other also with respect to a separate firing chamber 3'a interconnected by heating ports or openings 3''a to the heating chamber 3', wherein the retorts both vertical in FIG. 2 and horizontal in FIG. 3 are located, in both cases. As emphasized, the preferred operation in all cases is that the combustion gases pass through separate channels and not be mixed with the oil vapors and the hydrocarbon gases.

With special reference to FIGS. 2 and 3, FIG. 2 as explained represents a battery of vertical retorts 3; whereas FIG. 3 is a rotating, horizontal retort; preferably sloping to include passage and discharge of the oil shale. The latter as explained in connection with FIG. 1 (Section A) is fed into hopper 2 with feed mechanism 2a; and additionally 2a' in the case of FIG. 3; and passes thru the retort. The discharge and control mechanism for FIG. 2 is the same as that described in connection with FIG. 1; that in FIG. 3 depends upon the slope and rate of rotation of the horizontal retort. The spent shale is carried out by screw and/or belt conveyor to the gas producer as discussed above and shown as 4a and 4a' respectively. FIG. 3A as explained above is a crossection of FIG. 3. The remaining elements and numerals, not already referred to in connection with FIGS. 2 and 3 (and 3A) are: line 7 controlled by valve 7' (as in FIG. 1) for passage of oil vapors and hydrocarbons gases to (Frationator 8, FIG. 1); Also line 5 in FIGS. 2 and 3 for passage of combustion gases: (7a in FIG. 3 is a fan to induce flow which may be used in all cases); special elements shown in FIGS. 3 and 3A are: Rotation elements comprising motor and gear mechanism (FIG. 3); and rollers upon which the horizontal retort rests; and receiver Rx and additional elements necessary for spent shale discharge and removal. Special elements e.g. of the "star" type on the inside, and movable along the bottom of the retort (not shown) may be found useful to prevent sticking of the heated oil shale on the inside, and assist in removal of the same, in connection with heat transfer. The arrangements of FIG. 1 and the other two FIGS. 2 and 3 may be varied with respect to location of the gas producer, etc., or source of heat generally; and the facilities supplied to transport the spent oil shale (shown as 4a and 4a'); as well as for treatment of the ash as described in connection with FIG. 1A. Location of the latter facilities is a matter of choice and convenience.

Regarding yields of the primary products, various assays of the United States oil shales for oil yields, e.g. Green River Formation, show variations in yields of recoverable products for process use. e.g. of 16 to 65 gallons of crude oil per ton of oil shale but may vary on both sides. The deposits to be exploited are those which occur and are available in large amounts of satisfactory crude oil yield, and of course a number of other conditions must be considered as heretofore pointed out. A more or less typical oil shale from the Green River Formation (Western United States) may show a yield of about 20 gallons, (one-half barrel per ton) and about 2000 cubic feet of permanent gas at a retort temperature between about 800 to 900° F. (more or less) depending upon the time factor. As noted below, higher temperatures may be even more effective especially on capacity. It may also be noted at this point that the overhead distillate from fractionator 8 and/or partial condenser of the retort section A, FIG. 1, may consist of about 25% water containing ammonia and about 75% oil distillate (mainly gasoline), together amounting to less than 20% of the total oil product the remainder of about 80% which comes from the bottom of the fractionator 8 and passes to the cracking section B of the process in FIG. 1. It is also noted that both the ammonia and the hydrocarbons gases from fractionator 8 are recovered as a by-product. The spent shale was about 84% of the original oil shale and the ash about 61 % with about 23% of fixed carbon. The hot oil reflux from the bottom of the fractionator 8, FIG. 1 section A, (or FIG. 1A) which is essentially the crude shale oil minus the overhead light distillate fraction from fractionator 8 is pumped into the heating coil of the cracking section and may be heated to a temperature generally of from about 800° to 900° F., more or less, under a pressure of about 125 to about 150 pounds, more or less, in this section and discharged into the reaction and/or cracking or coking chambers, recycling the reflux condensate and recovering the overhead products.

The yield of pressure distillate, e.g. which contains the gasoling product, plus other distillate products of the process, in the present example on a non-residuum operation, (i.e. running to coke without withdrawing liquid residuum from the chamber), was 82% which on redistillation produced a NEP gasoline yield of 52% and bottoms yield equivalent to combined distillate heating oil, diesel oil, etc. of 24%. The latter could be reduced by further cracking to additional substantial yields of gasoline (if desired); or the heavier distillate used as on the above basis the yield of gasoline from the oil shale was about 17.2 gallons per ton of oil shale (including that produced in the retort section) and the heavier oil for heating, diesel and other uses, about 4 gallons per ton. It is noted at this point that the richer shales which have generally shown about 1 barrel per ton or 42 gallons of crude shale oil per ton of oil shale would produce twice the amount of gasoline and heavier distillate in the cracking conversion section of the process, i.e. 34.4 gallons per ton of oil shale of gasoline, and 8 gallons of the heavier oil distillates.

In the type of cracking operation referred to above, namely the non-residuum type, where there is no heavy residual liquid product, which is the preferred type since all of the liquid products are distillates in the form in greatest demand aand use. The residue coke product withdrawn from the reaction chamber, about 18% by weight of the oil charge is an excellent low ash fuel readily converted to producer gas as such (or enriched by the use of steam during the operation of the gas producer) as well as for other commercial uses; and the hydrocarbon cracked gas from the process (a rich gas averaging about 12 to 13 hundred BTU per cubic foot), is about 7% by weight of the oil leaving the bottom of the fractionator 8; (FIG. 1, section A). It is estimated that there is more than ample fuel available from the by-products in all of the above operations including as stated about 25% carbon in the spent shale, recovered by conversion to producer gas; the coke from the cracking operation referred to above which may be recovered to be used as producer gas or used as such i.e. as a solid low ash fuel; and the hydrocarbn gases from the retorting and cracking operations: to take care of the process operations, as well as fuel requirements for steam and power generation, refining operations and in general all fuel requirements for all purposes. The cracked gases may be used as such or mixed with the producer gas.

It is to be especially noted as pointed out heretofore that heat recovery generally is important in connection with the present invention and operation because of the special nature of the raw material (oil shale) since it must be processed relatively near the mining location to avoid shipping costs and the fuel employed in connection with all process and refining operations as well as for steam and power, etc. as emphasized above, must be generally of a by-product nature. It is also to be reemphasized that heat recovery from hot combustion gases from both the retorting (a) and cracking (B) sections as well as all other heat exchange operations should be utilized.

With regard to the refining of the distillate from the retort section of example in FIG. 1, FIG. 1A, etc. and the pressure distillate from the cracking section entirely satisfactory marketable products may be produced including the gasoline, and other distillates. in spite of off color appearance and offensive odor of the raw distillate; (and some adverse opinion apparently) it may be definitely stated that a water white stable gasoline of sweet odor, meeting all commercial specifications may be obtained by refining the pressure distillate using a modification of the sulphuric acid method; employing either batch or continuous operations and equipment. Briefly the method devised and tested in the present invention is as follows. The cracked shale oil distillate (to which may also be added the light overhead oil distillate from the retort section); (but preferably separately as described below) is water washed and treated with strong sodium hydroxide solution containing lead oxide $Pb_3O_4$ dissolved therein, referred to as "Plumbite" solution. A short water wash follows the drawing of the plumbite sludge. After settling, the distillate is given a preliminary treatment of about 1 pound of sulphuric acid per barrel of distillate employing a somewhat dilute acid at this state. The main acid treat of about 5 to 7 pound (1.84 spG acid) per barrel of distillate follows and after drawing the acid sludge from the latter the cracked distillate is water washed, the water drawn off, and the oil then treated with a solution of sodium hydroxide or plubmbite solution. The distillate is finally distilled, in the presence of sufficient steam to control the water white color of the overhead gasoline product, and the quality of the heavier distillate. If the gasoline distillate product at this stage is unstable, and tend to go off color on standing, the latter may be remedied by treating in the first instance with a light dilute sodium hydroxide wash followed by treatment with a small percentage of fullers earth, (or with the treating earth made from the oil shale ash as described herein). The gasoline or light oil distillate from the retort section A of the process may be withdrawn from the receiver, from the water, and given a light acid treatment followed (after water washing and drawing the sludge) by a light caustic treatment, and water wash, and then combined with the untreated pressure distillate and proceeding with distillation as described above.

The gasoline produced by cracking shale oil on analysis showed relatively high aromatic hydrocarbon equivalent which in comparison with petroleum cracked distillate from a wide variety of sources proved to be amenable to current methods of blending to obtain a good antiknock value, suitable in all respects for general motor fuel use; the conclusion being that it meets all requirements in this rspect.

In another cracking operation for comparison producing liquid residuum using a comparable topped cracked shale oil crude Sp.G. 0.8756 (with a pressure of about 150 pounds and temperature of about 820° F), the yield of pressure distillate was about 56% with a total yield based on the conversion of shale oil of 50% gasoline. It is noted that the incondensible gas yield on the non-residuum process is about 7% making coke only as a residue, whereas in making a liquid residuum it drops to between 4 and 5% of the charge. The heavy residual oil withdrawn from the reaction chamber was 35.4% and the coke produced about 4.5%. The flashing while hot, under a reduced relatively pressure in comparison with the prevailing pressure in the cracking section of the process; redistillation of the residual heavy oil would produce an overhead distillate and heavy liquid residue, or may be run to coke. This is considered a less desirable operation, although within the scope of the invention.

In view of the great importance of the retorting process which is an intergral part of the overall process in treating oil shales to produce the products described herein, it would appear desirable to point out a number of important factors bearing on this phase of the operation; not only with respect to yields of oil vapors which is reflected in the quality and amount of condensed heavier oil product collected in, and withdrawn from the bottom of the fractionator and partial condenser element 8 in FIG. 1 (and FIG. 1A); but also on the capacity and thruput of the process. This subject, e.g. the effect of temperature and time of heating upon yield, etc. has received some attention by workers in the field, and has been noted by others on different types of oil shale. The overall conclusion by applicant is that a rapid rate of producing the oil vapors at somewaht higher temperatures is desirable from the view point of capacity as well as yield. In one case an oil yield of about 45 gallons per ton of shale in less than two hours at a temperature of about 970° F. was observed; whereas at 872° F. the time required to yield 42 gallons per ton was 4 hours. It is also noteworthy that retorting at 850° F. drops the yield still further. In this particular case-apparently also in all of these cases the shale was partially reduced down to about one-fourth inch in size which indicates a wider range in this respect. It is expected therefore that quick retorting, e.g. at between 950° F. and 1000° F. or higher could result in larger thruputs with shorter time of exposure of the oil vapors and with high temperatures: also the probablity that there is a considerable range in these respects without adverse effects on the distillate products in the cracking or B section of the process, all of which should be an important factor in the economy of oil shale operations. There is, however, some likelihood of higher gas yields and somewhat less distillate yields; although this would be offset by the shorter time factor. However, from the data to date this type of operation looks very promising especially in connection with higher capacities of the retort section as a result of the operation referred to above. Moreover, the various types of oil shale retorts proposed by me (see drawings) should also be conducive to the improved result. It is also noted that the use of steam in the retort while limits is helpful both to rapid retorting and higher yields especially in connection with the novel design of the several types of retorts disclosed by me and operations connected therewith, as applied to oil shales. It is noted in the above connection that capacities of the cracking section of the process are generally considerably greater than the retort section, but this is a matter only of the number of retort units required in the battery. It may also be further noted that as a measure of economy the use of the oil shales fines, within limits, together with the larger pieces of oil shale may increase the quantity of oil proportionately and apparently reduces time of retorting. However, there is some evidence that too great a proportion of fines may reduce the overall yields of oil. Moreover, the fines may be employed as fuel if desired, e.g. in connection with the retorts shown in FIG. 2, 3 and 3A, and powdered coal may likewise be employed if available as well as powdered coke, thus conserving the gaseous fuels for other uses. In any event, the sources of by-product processing fuel for all needs including refining prosess production and other uses, appears assured.

The immediate foregoing relates to a number of improvements in the operation of the retort section of the process generally. It is my intention similarly to make use of, as set forth here certain improvements in the operation of the cracking section B in FIG. 1 as well as FIG. 1B in addition to those already discussed as well as in refining the liquid product of the section, e.g. I may take the major portion (of all) of the reflux from the dephlegmator 18 of the section B, FIG. 1, and pass it to a second heating coil in a separate furnace setting at a somewhat higher temperature than in the first furnace setting, heated for example as high as 970° F. and the topped crude shale oil from the bottom of fractionator 8 section A, FIG. 1, is cracked in the first heating coil already described, alone or preferably in admixture with a portion of the reflux at a higher range of temperatures, e.g. about 825° to 935° F. The arrangement of the reaction chambers may be the same as shown in FIG. 1B. Also it may be noted that in general the same pressure is maintained throughout the cracking section B except where liquid residuum is withdrawn and flashed at lower pressure to recover additional distillate. What applies to the cracking section of FIG. 1 also applies to FIG. 1B in connection with the above; it being understood that in all such cases suitable valves and lines may be supplied thereto, to control the operation as described.

It also may be noted in connection with FIG. 1, section B, that the vapors, etc in the line indicated as 18B and valve 18c may be passed to alternate treatments, e.g. (a) vapor phase refining of the pressure or cracked distillate by various methods relating to treatment of the vapors to refine the same, e.g. passing the vapors through fullers earth or similar refining clay for example the refining earth made from the spent shale as described above. Alternately the heavier portions of the overhead distillate from the dephlegmator of the cracking section may be separated from the light oil vapors by passing the vapors through a heat exchanger or partial condenser may be subjected to catalytic cracking employing a suitable catalyst, e.g. that made from the spent shale ash, and the use of a modification of the fixed bed or fluid catalyst or moving bed process or other system generally operated at temperatures of 850° F to 1000° F (more or less). It is thus clear that many variations of treating the distillate products may be employed, for example, heat and power; which might otherwise be wasted, or suitable substitutes available in other locations; or most important avoid the need for the use of valuable liquid products of the process as fuel. The question of heat econony in any event thus becomes an important question and I intend to claim the uses of such heat where both novelty and utility may be involved in connection with my novel process; as set forth below in addition to those already described above.

As set forth above generally in connection with the operation my novel unitary continuous process the topped shale oil from the retort section A is passed directly, while still hot, to the cracking section B and this is the preferred operation as described above. It is also pointed out that in order to maximize production capacity it is necessary to have a large number of process systems comprised or made up of sections A and B as described. In order to obtain maximum capacity, each battery of retorts in section A are generally balanced from the viewpoint of capacity or thruput, by the cracking section B, and on this basis there would normally be no need to store "topped crude shale oil" e.g. the hot product leaving the bottom of the fractionator also in section A. However there may be some situations where "shutdowns" of individual sections (e.g. for repairs, cleanouts and the like) may be involved; and heat recovered from any of these unbalanced sections e.g. the heat from topped shale oil crude cooled and sent to storage may be utilized for other uses; e.g. the occasional one of heating the cool oil from storage to the cracking section which may be idle or standby. These examples are merely for illustration only and are not to be considered as limiting as I intend to claim such recovery of heat wherever fuel or power equivalent is salvaged by the recovery and use of otherwise waste heat from my process; as well as in the refining of products from the same or production of steam or power in connection therewith. It may also include the heavier fractions of the overhead distillate from the dephlegmator (18 FIG. 1B) may be separated (using waste heat as indicated herein) into a gasoline fraction and a heavier oil fraction and treated as described above bearing in mind that the latter in this case is being upgraded with respect to octane value by catalytic cracking, to supply a greater demand for high octane gasoline at the expense of domestic heating oil, diesel fuel and the like-and the choice depends upon which product at the time is in greater demdnd. Also, heavier distillate fractions obtained from oil which may be sent to storage (in some circumstances) from the bottom of fractionator 8 section A (FIG. 1) or from the dephlegmator 18 (FIG. 1B) may be similarly catalytically cracked, as desired.

Also it may be noted that the distillate oil products made according to my process, are suitable in all respects as raw material for the petrochemical industry in fact as well as in name.

There are several additional questions in connection with my novel process for the treatment of oil shale to produce distillate fuel products, as hereinbefore described which should be emphasized.

One of them referred to above is the desirability, of not necessity, mainly from an economic viewpoint, to carry out the operations of my process in the vicinity where the oil shale is mined, because of the cost and impracticability of transportation, etc., the probable use of the oil shale ash (and/or spent shale) as refill material and other important reasons rather than to locations otherwise more suitable for processing.

Another very important question already emphasized which not only involves economics, but also technical and patent novelty (especially in the present case when operating near the source of the raw material for the process), is the availability of fuel, (particularly by-product fuel) required for processing including waste heat.

This includes recovery of heat from either or both sections of my process, many examples of which have already been set forth above. One specific example illustrated in FIG. 1B wherein the topped crude shale oil from the fractionator of Section A may have the heat removed by heat exchanger 23 which may be recovered in some circumstances for a multiplicity of uses. Another example is the partial condenser 8' in FIG. 1A. The recovery of heat from heat exchangers using the combustion gases leaving the retort in section A, and the heater in cracking section B are special examples of heat sources and recovery in the present unique situation demanding waste heat for fuel and power. The design of such a heater may not be novel, but the sources and uses of such heat derive their novelty from that of my process, and the urgent need to conserve otherwise waste heat for fuel and power in favor of maximum product yields: which otherwise would have to be used in the unique situation connected therewith. I have already pointed out a number of such sources and valuable uses of otherwise waste heat which should suffice as examples thereof.

Having described my invention and modifications thereof in considerable detail it is noted that it should not be limited thereby, but should be interpreted in accordance with the broad scope and spirit of the same as well as for its great importance both to our present energy situation and to the future independence of the nation in respect thereto. The term "reflux condensate" as used on occasion in the specification (also used in the petroleum cracking art generally), more particularly in connection with the fractionator or dephlegmator of the cracking section refers to the liquid condensate from the vapors of the higher boiling and heavier hydrocarbon oil vapors passing there through and which are condensed therein as a result, at least in part, of returning a portion of the lighter and lower boiling product of the process as a reflux, for the purposes of returning to condensate for further conversion.

I claim:

1. A continuous process for the production of distillate fuels, including motor fuels, domestic burning oils, diesel fuels, jet fuels and the like, from oil shales; which comprises heating a feed consisting essentially of oil shale in subdivided form to a conversion temperature; passing the conversion products, including hydrocarbon oil vapors and gases to a fractionating zone, wherein there is removed a light overhead product comprising hydrocarbon gases, water and ammonia, and wherein the primary heavier conversion products from the oil shale are condensed and separated as a liquid as a first stage in the process; passing the said condensed heavier oil products through a separate heating zone maintained under cracking and conversion conditions of elevated temperatures and pressures of 100 to 250 pounds and discharging the same into an enlarged conversion zone which is also maintained under cracking conditions of elevated temperatures and pressures of 100 to 250 pounds wherein cracking and conversion of the higher boiling to lower boiling products is continued to increase the yield thereof and to produce coke; passing the oil vapors and gases from the enlarged conversion zone to a dephlegmator wherein an overhead fraction consisting essentially of a pressure distillate in the boiling range of gasoline, domestic heating oils, diesel fuels, and jet fuels is removed, and the remaining bottoms fraction is recycled to said separate heating zone maintained under said cracking conditions.

2. A continuous process according to claim 1 wherein the step of passing said condensed heavier oil products through a separate heating zone is carried out while said heavier oil products are still in a heated condition.

3. A continuous process according to claim 1 wherein the step of heating the oil shale in subdivided form to a conversion temperature is carried out at substantially atmospheric pressure and under conditions whereby the oil vapors and gaseous conversion products are kept separate from the products of combustion of the fuel employed to heat the said oil shale, and wherein the gases and lower boiling products separated from the oil shale as a first stage in the process are recovered as overhead products.

4. A process as set forth in claim 1 wherein the hot shale oil leaving the said heating zone under high pressure and temperature conditions is discharged into the said enlarged zone under similar conditions of cracking and conversion to increase the yields of desirable distillate products therefrom and wherein substantially the only residual product produced in the process is solid coke, and the overhead products of the process are gases and distillates.

5. A process as set forth in claim 4 wherein the said enlarged zone is a suitable chamber and provision is made to switch from one chamber to another when filled with coke, as well as to remove said coke periodically whereby to assure continuous operation.

6. A process as set forth in claim 4 wherein a liquid residuum as well as a coke residue is formed in the enlarged conversion zone, and wherein the liquid residuum is removed while hot from the conversion zone, to a zone of reduced pressure in relation to the latter, whereby to recover a distillate fraction as well as a heavy residual oil from the said liquid residuum.

* * * * *